United States Patent [19]

Ueda et al.

[11] 3,930,351

[45] Jan. 6, 1976

[54] METHOD AND APPARATUS FOR TRANSFERRING YARN PACKAGES DOFFED FROM A TEXTILE MACHINE TO A CONTAINER

[75] Inventors: Shozo Ueda; Toshinori Taniguchi, both of Kariya, Japan

[73] Assignees: Kabushiki Kaisha Toyoda Jidoshokki Seisakusho; Daiwa Boseki Kabushiki Kaisha, Osaka, both of Japan

[22] Filed: July 24, 1974

[21] Appl. No.: 491,301

[30] Foreign Application Priority Data

Aug. 1, 1973 Japan ..... 48-90902

[52] U.S. Cl. ..... 53/35; 53/163; 214/6 H

[51] Int. Cl.[2] ..... B65B 5/10

[58] Field of Search ..... 53/35, 163, 162; 214/6 H

[56] References Cited

UNITED STATES PATENTS

| | | | |
|---|---|---|---|
| 2,506,661 | 5/1950 | Busse | 53/163 X |
| 2,668,626 | 2/1954 | Stuivenberg | 214/6 H |
| 3,683,582 | 8/1972 | Seguin | 53/163 X |

FOREIGN PATENTS OR APPLICATIONS

| | | | |
|---|---|---|---|
| 1,172,639 | 6/1964 | Germany | 53/163 |

*Primary Examiner*—Travis S. McGehee

*Attorney, Agent, or Firm*—Burgess Ryan and Wayne

[57] ABSTRACT

The present invention relates to a method and apparatus for transferring yarn packages doffed from a textile machine provided with a conveyer belt disposed along the longitudinal direction thereof, to a container. The yarn packages are carried to one end of the conveyer and then dropped into the container positioned at a receiving position below and next to the end of the conveyer. The dropping distance from the end portion of the carrying surface of the conveyer to the surface for receiving yarn packages in the container is always maintained at a substantially predetermined distance which is larger than the width L of one package, but smaller than the width of two packages.

6 Claims, 8 Drawing Figures

Fig. 1
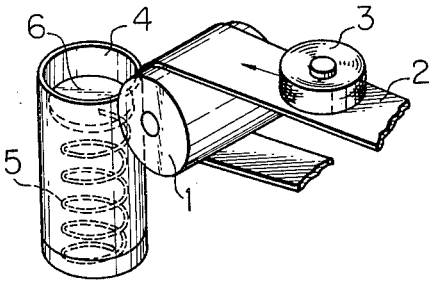
Fig. 2
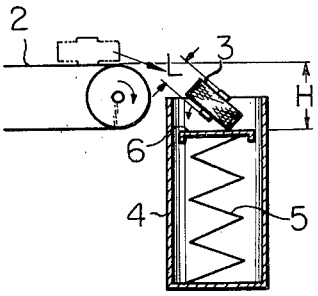
Fig. 3
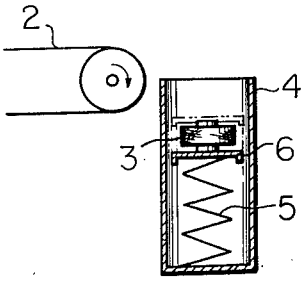
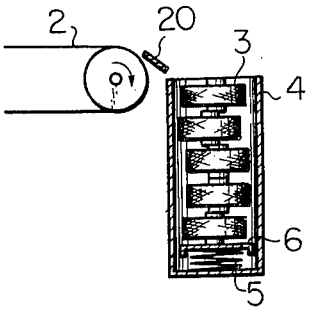
Fig. 4

METHOD AND APPARATUS FOR TRANSFERRING YARN PACKAGES DOFFED FROM A TEXTILE MACHINE TO A CONTAINER

SUMMARY OF THE INVENTION

The present invention relates to a method and apparatus for transferring yarn packages doffed from a textile machine, such as an open-end spinning machine, to a container.

According to our experience in mass production open-end spinning, it is well known that the yarn packages doffed from the respective spinning units are carried to an end portion of the machine frame by means of a conveyer belt and then transferred into a container in which they are transported to the successive process. However, if the yarn packages are stored in the container in irregular condition, the yarn packages are often damaged, or easy handling of the yarn packages when they are taken out of the container is made difficult. Therefore, it is necessary to store the yarn packages in the container in an orderly condition. Several solutions have been developed to satisfy the above-mentioned requirement, however, none have been completely satisfactory from a practical point of view. For example, a device for positively correcting the transferring condition of the yarn packages from the conveyer belt to the container was introduced. However, even though the above-mentioned device can be effectively utilized to satisfy the above-mentioned requirement, as the mechanism of the device is complicated and adoption of the device requires additional investment, there is still a requirement to create a practical method and apparatus to solve the above-mentioned problem.

It is the principal object of the present invention to provide a practical method and apparatus for transferring yarn packages doffed from a textile machine to a container, and to satisfy the above-mentioned requirement.

According to the present invention, the yarn packages doffed from each operational unit of a textile machine such as an open-end spinning machine are carried to an end position of the textile machine by a conveyer belt. The yarn packages are then put in a container adjacently positioned below the end of the conveyer belt in such a condition that the dropping distance of the packages from the end portion of the carrying surface of the conveyer belt to a surface for receiving the yarn packages in the container is always maintained at a substantially predetermined distance, so as to stop the free turning of the yarn packages at a point which will result in the packages being correctly positioned in the container. Further, the passage of the yarn packages when dropping into the container is regulated by a guide means disposed at the end portion of the conveyer belt. Consequently, the yarn packages carried by the conveyer belt are capable of being placed in the container in an orderly condition.

To attain the above-mentioned effect, a displaceable supporting means, such as a receiving plate which is resiliently supported in the container, is disposed in the container and a guide means for correctly forming a transferring passage of the yarn packages is preferably mounted on the end portion of the conveyer belt. Therefore, the construction of the apparatus according to the present invention is not complicated, and the installation cost of the apparatus is not expensive.

BRIEF EXPLANATION OF THE DRAWINGS

FIG. 1 is a perspective view of a storing apparatus embodying the present invention;

FIGS. 2 through 4 are cross sectional views of the storing apparatus shown in FIG. 1, which indicate storing states of packages;

DETAILED DESCRIPTION OF THE INVENTION

Figure 5:
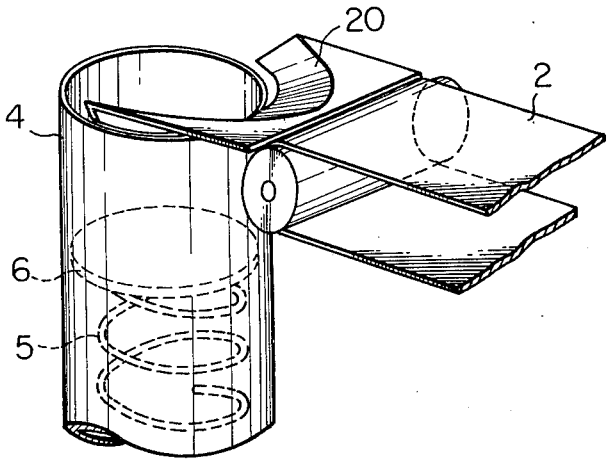
FIG. 5 is a perspective view of a guide means of a storing apparatus of the invention.

The most pertinent embodiment of the present invention is hereinafter first explained in detail with reference to the attached drawings FIGS. 1, 2, 3. In this embodiment, an endless conveyer belt 2 is disposed to an open-end spinning machine (not shown) along a longitudinal direction thereof and at a horizontal position above winding mechanism thereof. Yarn packages 3 doffed from the respective spinning units are transported in a substantially axially vertical standing condition to the discharge end of the conveyer belt 2. A container 4 is adjacently positioned below the end of the conveyer belt 2 so that the yarn packages 3 fall into the container 4. In the above-mentioned transfer motion of the yarn packages 3 from the conveyer belt 2 to the container 4, as a yarn package 3 moves from the end of the conveyer belt 2 under its own inertia, which depends upon the mass of the yarn package 3 and the carrying speed thereof, there is no assurance that the yarn packages 3 will be positioned in the container 4 in an orderly condition. That is, when the yarn package 3 leaves the end of the conveyer belt 2, the yarn package 3 drops in a parabollic curve and, therefore, if a receiving surface of the container 4, whereon the yarn package 3 is received, is located at an indefinite position in the container 4, it is impossible to store the yarn packages 3 in an orderly or aligned condition. Similarly, if the size of the full yarn packages changes due to different production lots, as the mass of the yarn packages 3 is also changed, the shape of the above-mentioned parabollic dropping curve is changed and, consequently, the above-mentioned difficulty in positioning the yarn packages 3 in an orderly condition is increased.

To solve the above-mentioned problems, in developing the present invention, experimental tests were repeated to determine how to position the above-mentioned receiving surface in the container 4 so as to eliminate the possibility of the yarn packages 3 being stored in a disorderly or misaligned condition in the container 4. Based on these tests it was concluded that, if the receiving surface can always be positioned in the container 4 in such a way that the distance between the carrying surface of the conveyer 2 and the receiving surface is maintained at a predetermined distance H (see FIG. 2), which is within a range of between the axial width L of the yarn package 3 and twice this axial width L, the yarn packages 3 can be deposited in the container 4 in an orderly condition. The technical reason for the above-mentioned conclusion is as follows. The body of the yarn package 3 inclines from the horizontal as the yarn package falls during its passage between the end of the conveyer belt 2 and the above-mentioned receiving surface and, therefore, if the above-mentioned distance H is always maintained the falling and inclining of the yarn package 3 is stopped at a point where the yarn package 3 comes to rest on the receiving surface in the container 4 in an axially vertical condition.

To create the above-mentioned condition of the receiving surface, a receiving disc 6 is movably provided in the container 4. The receiving disc 6 is always urged upward by a spring 5, which is chosen based on the requirement that it is capable of being compressed by a length corresponding to the width L of the package 3 by the weight of the package. Because of this, the receiving space H is always kept substantially constant without relation to the number of yarn packages 3 stored in the container 4 as shown in FIGs. 2, 3 and 4. Instead of the spring 5, other means which can keep the receiving space H constant, such as a cylinder means, are also applicable to the present invention.

As mentioned above, according to the present invention packages 3 are regularly stored in axially vertical and superimposed condition in the container.

Based on our experimental tests, it is preferable to restrict the dropping passage of the yarn packages 3 to a predetermined parabolic dropping passage in order to avoid contact with the container. To create this condition, it is preferable to dispose a means for guiding the yarn packages 3 at a position between the conveyer belt 2 and the container 4. Referring to FIG. 5, a guide plate 20 is arranged at the discharge end of the conveyer belt 2. The form of the guide plate 20 is funnel-shaped or partly funnel-shaped. The guide plate 20 may be stationarily mounted to a frame (not shown) of the spinning machine. However, it is more advantageous that the guide plate be movable from the operating position where the guide plate guides a package from the conveyer belt to the container to a non-operating position where the guide plate is situated above the conveyer belt and vice versa. If such a movable guide plate is used, the guide plate in the non-operating position will not be an obstruction to the operator when the guide plate is unnecessary during a spinning operation.

In a case where the discharge-end of the conveyer is positioned inside the out-end box (or the off-end box) of the spinning machine and doffed packages are discharged from an opening of the box, and where the guide plate is movable from the operating position outside the box to the non-operating position inside the box, it is preferable to provide a door for covering said opening in order to protect the guide plate in the non-operating position from fly and dust. Further, it is even more preferable that the opening motion of the door causes the movement of the guide plate from the non-operating position to the operating position and the closing motion of the door causes the movement of the guide plate from the operating position to the non-operating position.

Figure 6:
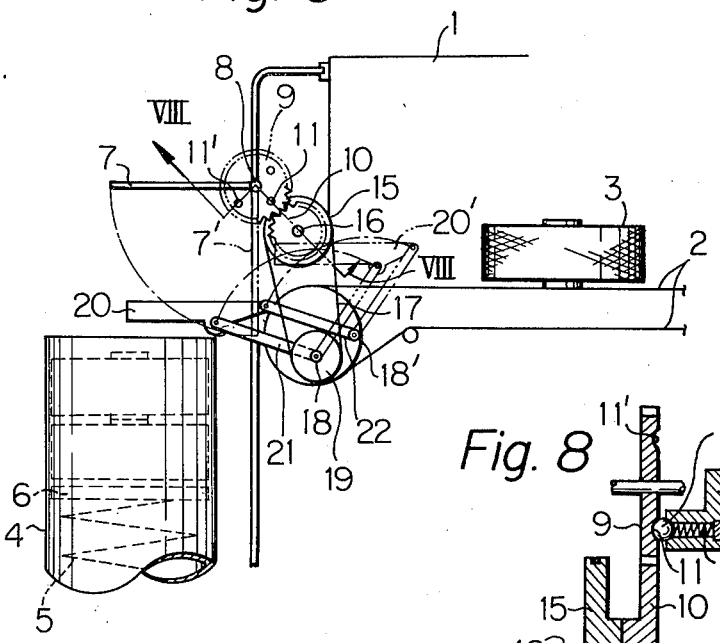
FIG. 6 is a side elevation view of other embodiments of the storing apparatus of the invention.
Figure 8:
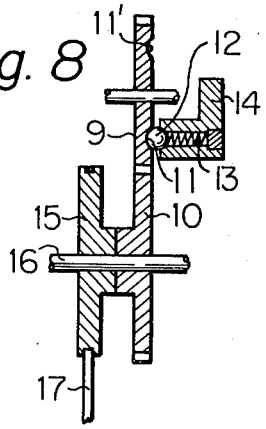
FIG. 8 is a sectional view taken along the line VIII—VIII in FIG. 6.
Figure 7:
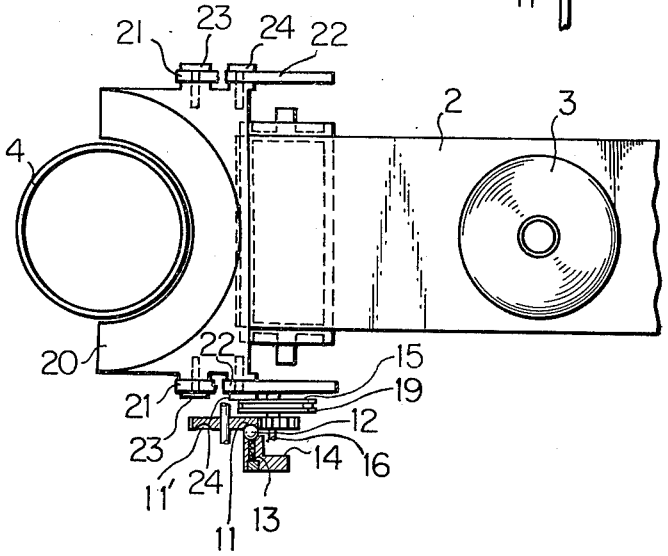
FIG. 7 is a plane view of the apparatus shown in FIG. 6.

To attain the above-mentioned movement of the door, a swinging mechanism is mounted on the machine frame (not shown) as follows. In FIGS. 6 and 7, the guide plate 20 is pivotably supported at its both sides by levers 21, 22 with pivots 23, 24. The other ends of the levers 21, 22 are turnably connected to shafts 18, 18' which are secured to the frame of the spinning machine. Levers 21, 22, the guide plate 20 and the shafts 18, 18' form a parallelogram, whereby the guide plate 20 is always kept in an approximately horizontal condition. The lever 21 is engaged with a pulley 19 mounted on the shaft 18. A door 7 is swingably arranged with a pivot 8 at the end of the frame of the spinning machine and is provided with a gear 9. On the side of the gear 9 at least two hollows 11, 11' are formed and the hollows 11, 11' engage a ball 12 to stop further rotation of the gear and to determine the position thereof. In FIGS. 7 and 8 the numeral 13 designates a coil spring and the numeral 14 designates a ball-holder. A gear 10 engages with the gear 9. A pulley 15 is mounted on the shaft with the gear 10 and the pulley 15 is connected to the above-mentioned pulley 19 via a belt 17. The numeral 16 is a shaft for the gear 10 and a pulley 15.

The above-mentioned mechanism is operated as follows. When packages 3 are doffed in a spinning machine, the door 7 is swung upward so that it no longer obstructs the space above the end of the conveyer belt 2. In connection with the opening of the door, the gear 10 engaged with the gear 9 is rotated and this rotation is transmitted to the pulley 19 through the belt 17. This results in the lever 21 engaged with the pulley 19 being pivoted on the shaft 18 so that the guide plate 20 is moved from a position indicated in FIG. 6 by broken lines to the position indicated by solid lines.

After the guide plate 20 is positioned as indicated by solid lines in FIG. 6, packages 3 transported by the conveyer belt 2 leave the end of the conveyer belt 2 and slip down on the funnel-shaped surface of the guide plate 20 to drop into the container 4, always in axially vertical condition. When a container 4 is filled with given number of packages 3, the full container 4 is exchanged for an empty container. This exchange of full containers for empty containers is repeated until all of the doffed packages are stored. The door 7 is closed when the storing of doffed packages is completed, so that the guide plate 20 is again moved to its position above the conveyer 2 shown by broken lines in FIG. 6.

The door 7 may be opened and closed manually. Otherwise, the opening and closing of the door 7 and movement of the guide plate 20 may be accomplished automatically by connecting the shaft 16 of the gear 10 and pulley 15 to a driving source, e.g. an electric motor. The open state and closed state of the door 7 and advanced state and retired state of the guide plate 20 are ensured by engagement of the ball 12 with the hollows 11, 11'. However, of course, other known means for maintaining things at a certain position may be substituted for said ball 12 and hollows 11, 11' in order to obtain the above-mentioned states.

According to the above-described embodiment, contact of a package 3 with the container can be prevented by the guide plate 20, so that the package 3 is not damaged.

While the preferred embodiments have been illustrated and described, it will be apparent to those skilled in the art that modifications are possible without departing from the scope of the invention.

What is claimed is:

1. A method for transferring yarn packages doffed from a textile machine provided with a conveyer belt disposed along a longitudinal direction thereof to a container, comprising the steps of carrying the yarn packages doffed from said textile machine along a path having a horizontal component of direction to an end of the conveyer, and then ejecting the yarn packages from the end of the conveyer at a velocity sufficient to cause the yarn package to fall along a parabolic path due to the horizontal momentum imparted to the packages by the conveyer, on to a receiving surface, and maintaining the receiving surface at a substantially constant vertical distance from the upper surface of said conveyer, said distance being from one to two times the width L of a yarn package.

2. Method according to claim 1 characterized in that the passage taken by the falling yarn package when it drops into the container is positively regulated.

3. Apparatus for transferring yarn packages doffed from a textile machine, comprising a conveyer belt disposed along longitudinal direction wherein yarn packages doffed from said textile machine are carried to an end of the conveyer along a path that has a horizontal component of motion and then ejected by the conveyer along a parabolic path, a container positioned at a receiving position adjacently below and horizontally spaced from the end of the conveyer, a disc displaceably disposed in the container, a helical spring disposed at a position below the disc and in contact with the disc, the disc being positioned within a range of between L and 2L from the carrying surface of the conveyer wherein L defines the axial width of the package, the spring constant being sufficient to permit deformation by the length L when a yarn package is placed on the disc.

4. Apparatus according to claim 3 further comprising a guide plate disposed at the end portion of the conveyer.

5. Apparatus according to claim 4 further comprising a door disposed at the end of conveyer and a swinging mechanism for advancing and retiring the guide plate in response to the movement of the door.

6. Apparatus according to claim 5, wherein said swinging mechanism comprises a parallelogram pivoted on said guide plate, and a first pulley on which said parallelogram is further pivoted, and wherein said door is provided with a second pulley, and a belt connecting said first and second pulleys.

* * * * *